US007104342B2

(12) United States Patent
Berg

(10) Patent No.: US 7,104,342 B2
(45) Date of Patent: Sep. 12, 2006

(54) ACTIVE ROTATIONAL BALANCING SYSTEM FOR ORBITAL SANDERS

(76) Inventor: Frederic P. Berg, 9809 38th Ave. NE., Seattle, WA (US) 98115

( * ) Notice: Subject to any disclaimer, the term of this patent is extended or adjusted under 35 U.S.C. 154(b) by 0 days.

(21) Appl. No.: 10/953,636

(22) Filed: Sep. 29, 2004

(65) Prior Publication Data

US 2006/0065415 A1 Mar. 30, 2006

(51) Int. Cl.
*B24B 49/00* (2006.01)

(52) U.S. Cl. ..... 173/1; 173/2; 173/49; 451/5; 451/357

(58) Field of Classification Search ..... 173/2, 173/217, 183, 171, 1, 49; 51/169, 165.73, 51/165.87; 451/5, 8, 24, 343, 357; 74/573 R, 74/573 F, 572; 73/468, 470
See application file for complete search history.

(56) References Cited

U.S. PATENT DOCUMENTS 4,458,554 A * 7/1984 Hrastar ..... 368/171
4,537,177 A * 8/1985 Steere et al. ..... 125/13.02
4,905,419 A * 3/1990 Makarov et al. ..... 451/21
5,099,430 A * 3/1992 Hirsch ..... 73/462
5,125,188 A * 6/1992 Ogawa et al. ..... 451/5
5,549,019 A * 8/1996 Cattani ..... 74/570.2
5,688,160 A * 11/1997 Pozzetti et al. ..... 451/5
6,206,771 B1 * 3/2001 Lehman ..... 451/357
6,210,099 B1 * 4/2001 Hugbart et al. ..... 415/13
6,606,922 B1 * 8/2003 Case et al. ..... 464/180
6,974,362 B1 * 12/2005 Lindell et al. ..... 451/5

* cited by examiner

*Primary Examiner*—Scott A. Smith
(74) *Attorney, Agent, or Firm*—Black Lowe & Graham PLLC

(57) ABSTRACT

A system for active dynamic balancing of a rotating tool driven by a motor having a shaft supported by a first and second bearing on opposing sides of the motor includes an acceleration sensing assembly configured to sense radial accelerations on the shaft producing an acceleration signal indicative of the radial accelerations. A correcting mass assembly is configured to rotate with the shaft and to move at least one mass radially to the shaft responsive to a correcting signal. A controller is configured to receive the acceleration signal generating a correcting signal by means of a closed loop iterative algorithm.

13 Claims, 7 Drawing Sheets

Phase Shift

ACTIVE ROTATIONAL BALANCING SYSTEM FOR ORBITAL SANDERS

FIELD OF THE INVENTION

This invention relates generally to electrically or pneumatically powered hand tools and, more specifically, to dynamically compensated electrically or pneumatically powered hand tools.

BACKGROUND OF THE INVENTION

Sanders are generally described by the characteristic motion by which drive their abrasive; sanders may be orbital, in-line, disk, or belt sanders. In-line, disk, and belt sanders gouge distinct abrading marks on the surface of the workpiece, by the cumulative effects of the abrading medium as it travels in the same direction. To produce a suitable finish, another tool, such as an orbital sander later must remove the resultant abrasion marks. Orbital sanders produce a more random abrading pattern, therefore, a more uniform and desirable surface finish. In general, using belt, inline, and disk sanders is limited to aggressive surface abrading of the workpiece surface.

Orbital sanders drive a sanding pad in an eccentric orbit around the motor shaft centerline. Operators prefer orbital sanders because of their controllability. When abrading a surface, an operator has excellent control of sander position, which is important because it allows the operator to abrade a precisely defined area, such as abrading next to masking tape or to a perpendicular surface. In contrast, belt, in-line, or disk, apply a reactionary force to the operator, opposite the direction of sanding medium motion. To keep such a sander in one location, the operator must always provide an equal reactionary force. As a result, belt, in-line, and disk sanders are more difficult to control.

Orbital sanders, however, generate relatively high vibration levels, up to 30 $m/s^2$. With long exposures, these levels are often injurious to the operator, resulting in serious long-term nerve, vascular, or musculoskeletal damage of an upper extremity. The vibration is the result of imbalanced rotational forces along the shaft-assembly. These forces are dependent on operator pushing force as well as variations in counterweight mass, sanding pad mass, and sanding medium mass.

Orbital sanders have been limited in use to less aggressive abrading tool because of their vibration levels. A more aggressive orbital sander is one that swings its sanding pad at larger orbits that is with greater eccentricity rather than by increasing rotational speed. As a result, the sander drives the pad to abrade more area per orbit. The most aggressive orbital-sanders typically have ⅜-inch diameter orbits with rotational speeds between 10,000 and 12,000 orbits per minute.

Orbital sander manufacturers have not been able to design the vibration out of orbital sanders. The vibration results from imbalance, and in the design of orbital sanders, imbalance, in large part, stems from the displacement of a center of gravity from a center of rotation. Given the variety of weights of sandpapers, any replacement of sandpaper can offset the center of gravity from the center of rotation. Due to the varying weight of sandpaper, a single offset design is not possible.

The disadvantages associated with current orbital sanders have made it apparent that a new orbital sander that generates less vibration and is more aggressive is needed.

SUMMARY OF THE INVENTION

A system for active dynamic balancing of a rotating power tool driven by a motor having a shaft supported by a first and second bearing on opposing ends of the motor includes an acceleration sensing assembly configured to sense radial accelerations on the shaft producing an acceleration signal indicative of the radial accelerations. A correcting mass assembly is configured to rotate with the shaft and to move at least one mass radially to the shaft responsive to a correcting signal. A controller is configured to receive the acceleration signal generating a correcting signal by means of a closed-loop iterative algorithm.

An active dynamic rotational balancing system corrects for both the radial imbalance forces and the operator pushing force generated by orbital sander operation. When these corrections are made, all rotational force interactions with the handgrip are greatly reduced; this results in lower handgrip vibration levels.

A system uses a programmable microcontroller to implement the feedback control algorithm and to operate two miniature stepper motors that reposition correction masses. Two accelerometers integrated into the bearing mounts provide feedback information. The programmable microcontroller compensates for a phase shift difference with reference to an optical sensor. Each stepper motor operates a lead screw to move correction masses radially in the two planes of imbalance to correct for both the radial imbalance forces and for the operator pushing force generated by orbital sander operation. When the stepper motor compensates for them, all rotational force interactions vibrating the handgrips are greatly reduced.

A force biasing mechanism is incorporated into the system to provide four times the compensating force of a system without the mechanism. Using acceleration data from feedback sensors imbedded into the handgrip as well as a shaft position sensor and microcontroller, the mechanism is directed to correctly redistribute correction mass in two planes, which are perpendicular to the rotating shaft, to dynamically balance the entire rotational system. An active rotational balancing system corrects for variations in the rotational system, to produce a balanced force system.

As will be readily appreciated from the foregoing summary, the invention provides an active dynamic rotation balancing system for a rotating tool.

BRIEF DESCRIPTION OF THE DRAWINGS

The preferred and alternative embodiments of the present invention are described in detail below with reference to the following drawings.

DETAILED DESCRIPTION OF THE PREFERRED EMBODIMENT

Figure 1A:
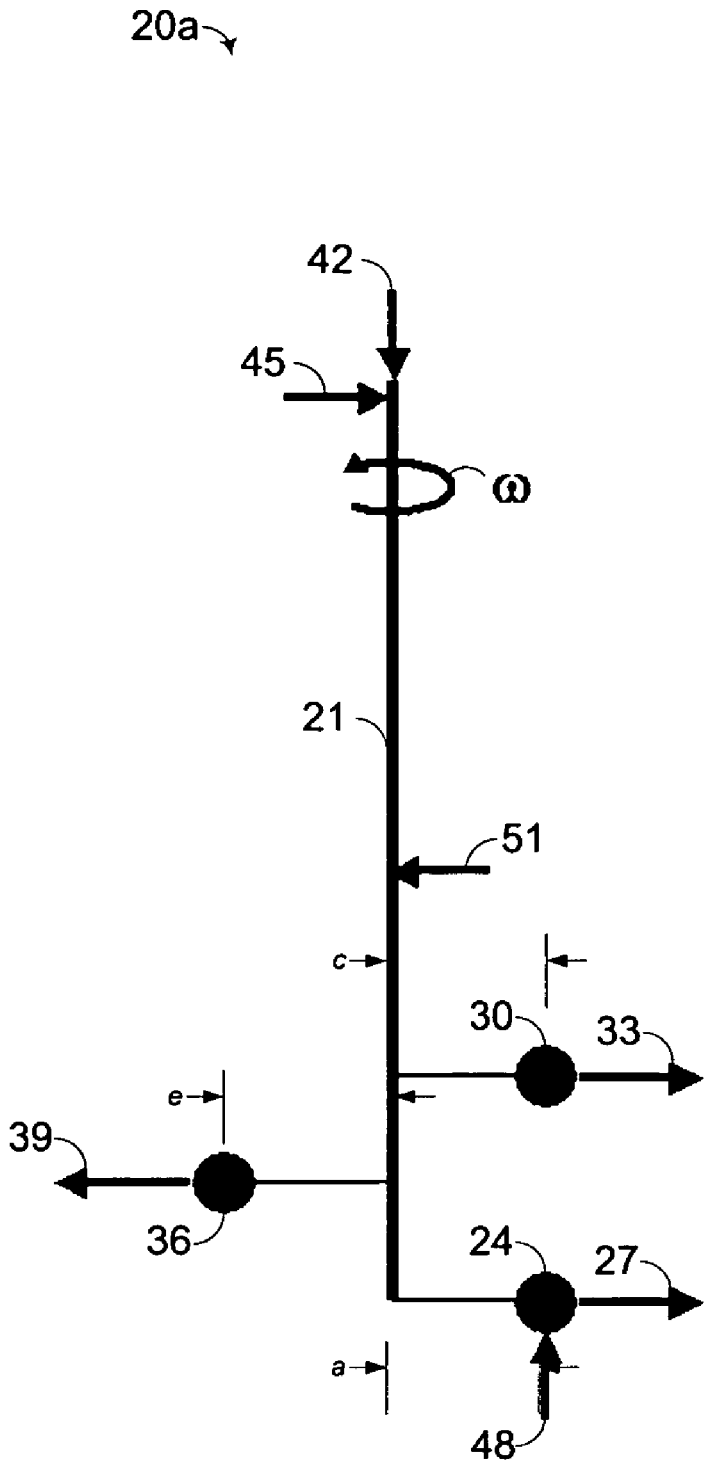
FIG. 1*a* is a force analysis diagram for an active dynamic rotation balancing system for a rotating tool.

Referring to FIG. 1*a*, a force diagram 20 aids in the description and analysis of the forces causing vibration in an orbital sander. In this diagram the forces are all coplanar. A motor shaft 21 spinning about that axis at a rotation speed of ω provides a frame of reference. The motor shaft 21 is the principal moving part of the orbital sander and drives the operational components including the sanding pad with attached sandpaper. For purposes of analysis the sanding pad assembly may be fairly represented by a point mass located at a center of the constituent mass. The motor shaft 21, can be assumed symmetrical around the motor shaft axis and with homogeneous density, thereby not contributing to any imbalance in the system.

The mass of the sanding pad assembly with sandpaper can be represented by mass 24 at distance a from a motor shaft axis 21 of rotation. At rotational speed ω, the mass 24 imparts a rotational force 27 on the motor shaft axis 21, that is the product of radius a times the magnitude of the mass 24, and the square of the rotational velocity, i.e. $\omega^2$ ($F=mr\omega^2$). Vibration results as time-varying reactionary forces, and in the case of the orbital sander transmits through the bearings and contributes to the horizontal top bearing force 45 and the bottom bearing force 51.

Along with forces imparted simply by the rotation of the shaft, vibration stems from time-varying reactionary forces fed to the orbital sander motor shaft 21 by action of the operator. The operator pushing the sander across the surface of the workpiece and pressing the sander to the workpiece with a vertical pushing force 42 that together with the gravitational force impart a vertical pushing force 48 through the workpiece acting on the shaft, thus forming a force couple. Vibration results as time-varying reactionary forces, and in the case of the orbital sander transmits through the bearings and contributes to the horizontal top bearing force 45 and the bottom bearing force 51.

To counteract the reactionary forces, i.e. the horizontal top bearing force 45 and the bottom bearing force 51, a top correction-mass 30 and a bottom correction-mass 36 spin with motor shaft 21, at radii c and e respectively, and produce forces respectively. As set forth above, the resulting forces, forces 33 and 39 are proportional to the rotational velocity squared $\omega^2$, and respective radii c and e. The force diagram demonstrates that by suitably selecting the radii c and e respectively, the reactionary forces are effectively counterbalanced eliminating the reactionary forces, i.e. the horizontal top bearing force 45 and the bottom bearing force 51. Suitably varying the radii c and e is a dynamic process as the pushing force 42 varies Referring to FIG. 1*b* (the elements present remain as set forth as in FIG. 1*a* discussed above), as the rotational velocity ω, a phase-shift phenomenon exists, resulting from the time difference between when the rotational system produces a maximum force and when the corresponding forces are measured. In other words, the force measured is not necessarily coplanar to the correcting forces 33 and 39. The measured force must be adjusted by the phase-angle ϕ to obtain bearing forces that are coplanar to the correction-forces 33 and 39. If the phase-angle ϕ equals zero, then the measured bearing forces 45 and 51 are coplanar to the correction-forces 33 and 39.

The phase-angle ϕ is measured using an optical sensor 75 in a presently preferred embodiment though as will readily be perceived by those skilled in the art, any suitable motor shaft 21 indexing device will serve to measure the phase-angle ϕ. The purpose of the indexing device such as the optical sensor 75 is to inform the controller of the phase-angle of the motor shaft 21 as it rotates, whereas the accelerometers 54, 57 indicate the magnitudes of the top bearing force 45, and the bottom bearing force 51.

Figure 1B:
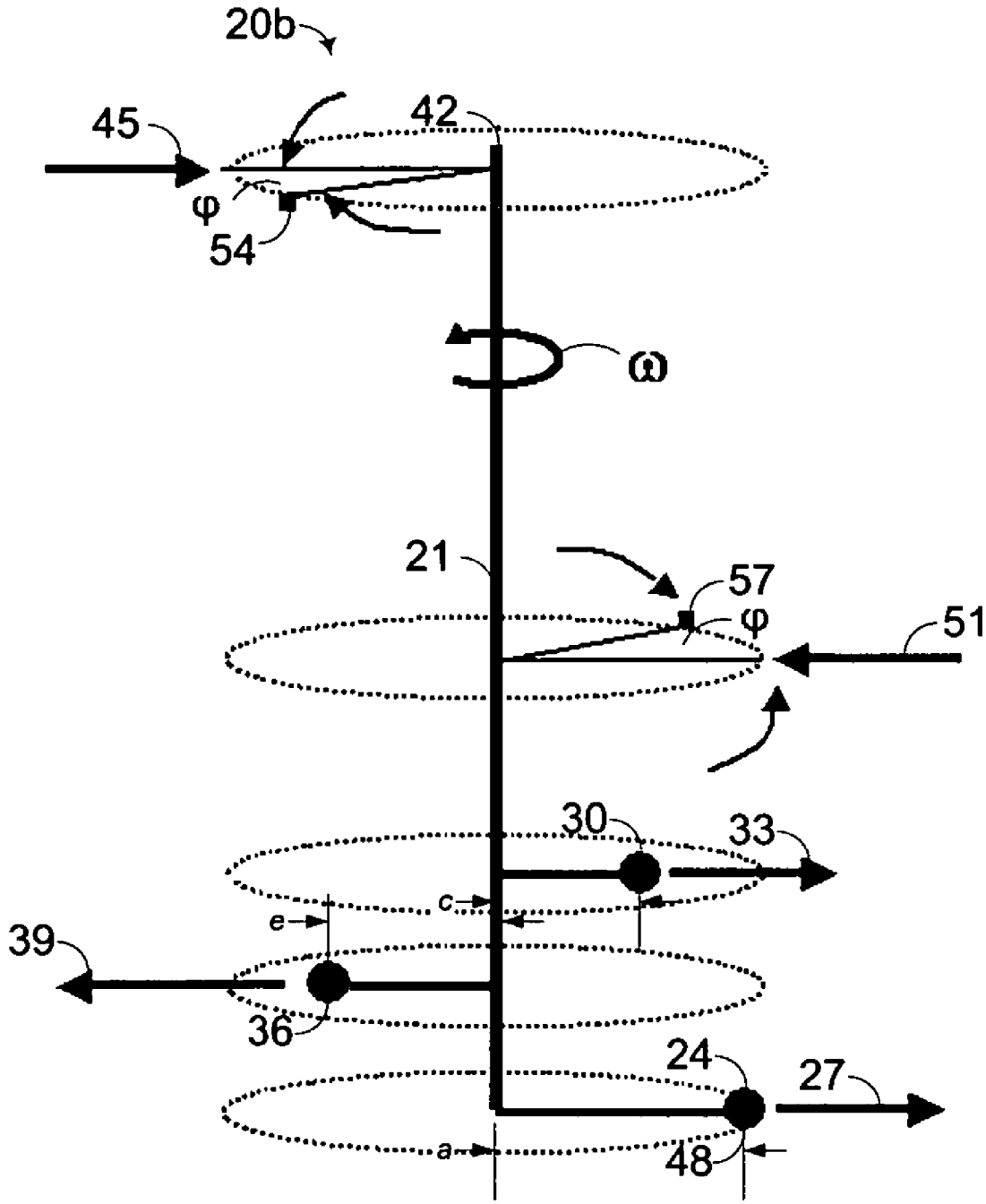
FIG. 1*b* is a force analysis diagram for the active dynamic rotation balancing system for a rotating tool showing a phase-angle shift.
Figure 2:
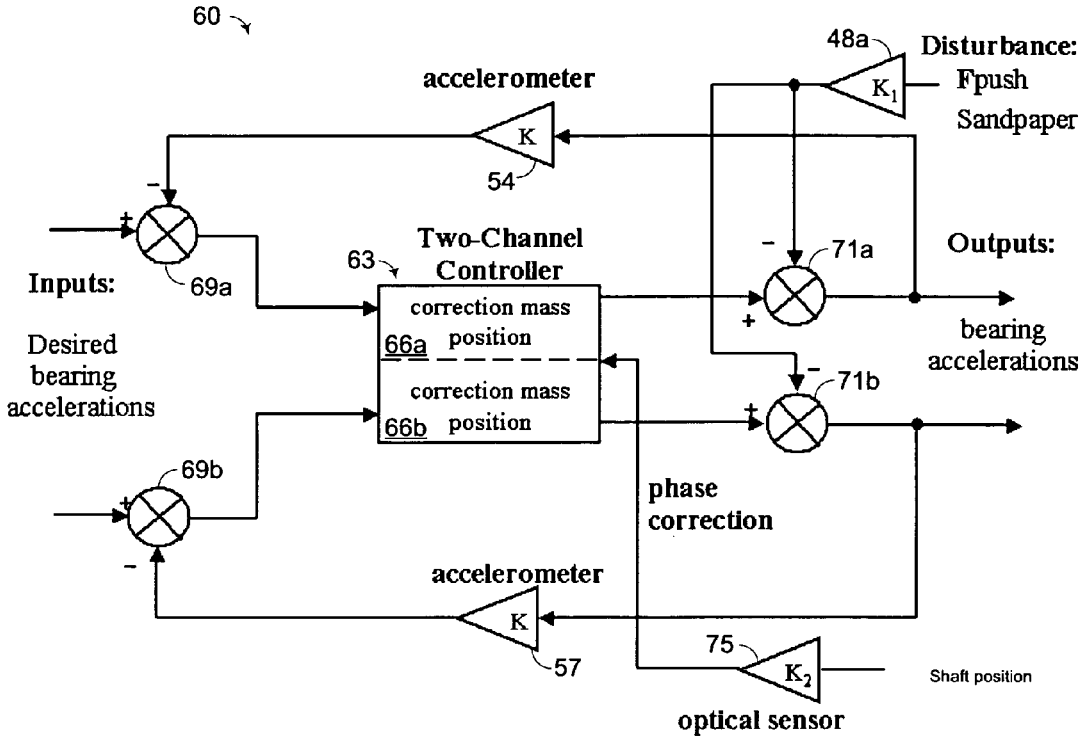
FIG. 2 is a block diagram of an electronic control assembly for the active dynamic rotation balancing system for a rotating tool.

Referring to FIGS. 1*a*, 1*b*, and 2, a controller 63 comprises two processing channels, a top channel 66*a* and a bottom channel 66*b*. The top channel 66*a* is configured to minimize the top bearing force 45 and the bottom channel 66*b* is configured to minimize the bottom bearing force 51. The controller 63 controls the radial positions, at radii c and e respectively, of the top correction-mass 30 and the bottom correction-mass 36, to produce forces 33 and 39. As forces 33 and 39 are optimized, the top bearing force 45 and the bottom bearing force 51 are minimized. Characteristic of a closed-loop program, the outputs are measured with accelerometer 54 and accelerometer 57, then fedback and compared to the desired input. If they are not the same the controller 63 makes adjustments to drive them to be the same.

The controller receives inputs from mixers 69*a* and 69*b* by the top channel 66*a* and the bottom channel 66*b* of the controller 63 respectively. The mixers receive a signal as a negative input from the accelerometers 54 and 57 for the top bearing acceleration, which is represented by the top bearing force 54, and the bottom bearing acceleration, which is represented by the bottom bearing force 57 respectively. Since accelerometers measure acceleration, the controller 60, works in acceleration instead of working in force values. Force and acceleration are proportional. The mixers 69*a* and 69*b* receive inputs representative of a zero acceleration input as a positive input for comparison with the output of the top and bottom bearing accelerometers 54 and 57 respectively. These inputs are corrected for phase angle information received by the optical sensor 75 to determine an appropriate signal for determining a position for varying the positions of the top correction-mass 30 and the bottom correction-mass 36 by varying radii c and e respectively.

A second mixer 71*a* modifies the output of the top channel 66*a* as a second mixer 71*b* modifies the output of the bottom mixer according to the input of a force disturbance that could be from several different sources, such as the operator pushing on the sander and/or a change in sandpaper mass from either installing a new piece of sandpaper, loading the current sandpaper with work-piece particles, or degrading the current sandpaper by loosing abrasive particle media.

Figure 3:
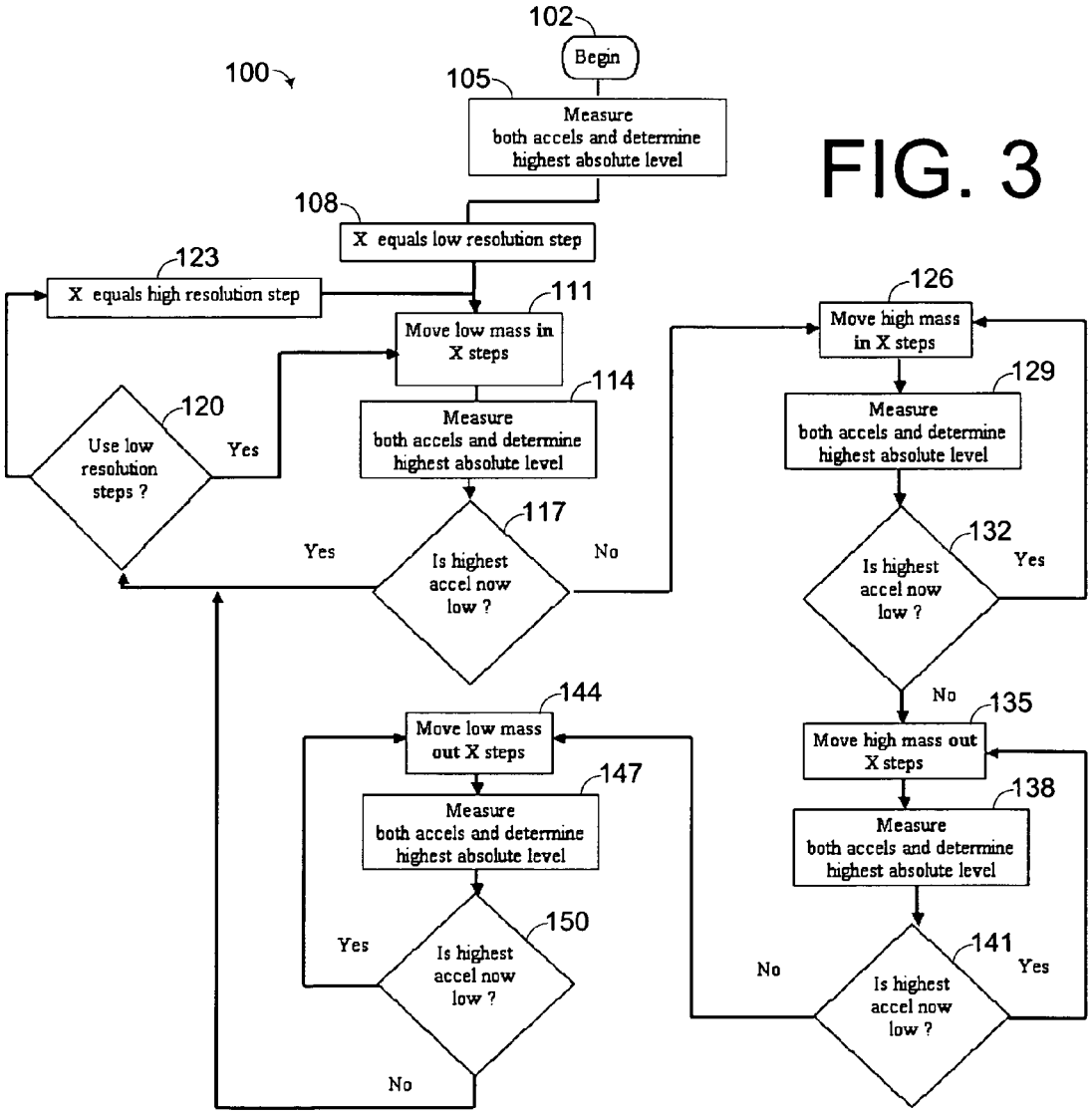
FIG. 3 is a flow chart of an algorithm for controlling the active dynamic rotation balancing system for a rotating tool.

Referring to FIG. 3, in a presently preferred embodiment an effective two-channel control algorithm 100 begins at a block 102 and operates continuously while the sander drives the sandpaper and only ends when the orbital sander is turned off. The purpose of the control algorithm 100 is to move correction-masses 30 and 36 until both phase-corrected bearing acceleration 45 and bearing acceleration 51 are near or equal to zero. Another objective of algorithm 100 is to get both phase-corrected bearing acceleration 45 and phase-corrected bearing acceleration 51 to zero or near zero in a short amount of time. Although there could be other more efficient algorithms, algorithm 100 has proven to function effectively.

The algorithm 100 has the feature to change from coarse to fine resolution by assuming a large step size (displacement) of correction-mass position. In the current algorithm, the low resolution displacement value is ten times longer than the high resolution displacement value.

In algorithm 100, after both bearing accelerations have been corrected for the phase-angle ϕ offset they are combined for comparison purposes. This combined value has the advantage of having only one acceleration level to compare instead of two. Determining the absolute value of each top bearing acceleration 45 and bottom bearing acceleration 51 calculate this comparison level. The higher of the two absolute acceleration levels is the comparison value. When the comparison value is near or equal to zero, then the bearing accelerations 45 and 51 are also near or equal to zero and the sander housing will transmit minimal vibration to the operator's hand.

At a block 105, the controller receives signals from the optical sensor 75 and the accelerometers 54 and 57 to derive the phase corrected top and bottom bearing accelerations. At a block 105, the highest absolute acceleration level (the comparison value) is calculated, as described above. This initial highest absolute acceleration is the baseline level.

At a block 108, the mass displacement, or movement step size is set to the low-resolution value.

At a block 111, the controller moves the bottom correcting mass 36 by decreasing the radius e.

Again, at a block 114, the highest absolute acceleration level is calculated, as described above, as in the block 105.

At a decision block 117, the algorithm compares the new highest absolute acceleration level to the baseline level in order to determine if the movement of the mass at block 111 has reduced the acceleration.

If the new highest absolute level is lower than the baseline level, then the new highest absolute level is made equal to the baseline level, and the old baseline level is erased. At a decision block 120, the algorithm determines whether to use the low resolution mass displacement value or the high-resolution displacement value. In either case, again at a block 111, the controller moves the bottom correcting mass 36 by decreasing the radius e. Again the steps in block 114 and decision block 117 are repeated. While the new highest absolute level is lower than the baseline, steps in block 120, block 111, block 114 and decision block 117 are repeated again and again until the new highest absolute level is higher than the baseline.

When at decision block 117, the new highest acceleration level is higher than the baseline level, the step in block 126 is initiated. At a block 126, the controller moves the top correcting mass 30 by decreasing the radius c. At a block 129, and as in a block 105, the highest absolute acceleration level is calculated. At a decision block 132, the algorithm compares the new highest absolute acceleration level to the baseline level in order to determine if the movement of the mass at block 126 has reduced the acceleration.

If the new highest absolute level is lower than the baseline level, then the new highest absolute level is made equal to the baseline level, and the old baseline level is erased. Again at a block 126, the controller moves the top correcting mass 30 by decreasing the radius c. Again the steps in block 129 and decision block 132 are repeated. While the new highest absolute level is lower than the baseline, steps in block 126, block 129 and decision block 132 are repeated again and again until the new highest absolute level is higher than the baseline.

When at decision block 132, the new highest acceleration level is higher than the baseline level, the step at block 135 is initiated. At a block 135, the controller moves the top correcting mass 30 by increasing the radius c. At a block 138, and as in a block 105, the highest absolute acceleration level is calculated. At a decision block 141, the algorithm compares the new highest absolute acceleration level to the baseline level in order to determine if the movement of the mass at block 135 has reduced the acceleration.

If the new highest absolute level is lower than the baseline level, then the new highest absolute level is made equal to the baseline level, and the old baseline level is erased. Again at a block 135, the controller moves the top correcting mass 30 by increasing the radius c. Again the steps in block 138 and decision block 141 are repeated. While the new highest absolute level is lower than the baseline, steps in block 135, block 138 and decision block 141 are repeated again and again until the new highest absolute level is higher than the baseline.

When at a decision block 141, the new highest acceleration level is higher than the baseline level, the next step is initiated. At a block 144, the controller moves the bottom correcting mass 30 by increasing the radius c. At a block 147, and as in a block 105, the highest absolute acceleration level is calculated. At a decision block 150, the algorithm compares the new highest absolute acceleration level to the baseline level in order to determine if the movement of the mass at block 144 has reduced the acceleration.

If the new highest absolute level is lower than the baseline level, then the new highest absolute level is made equal to the baseline level, and the old baseline level is erased. Again at a block 144, the controller moves the bottom correcting mass 36 by increasing the radius e. Again the steps in block 147 and decision block 150 are repeated. While the new highest absolute level is lower than the baseline, steps in block 144, block 147 and decision block 150 are repeated again and again until the new highest absolute level is higher than the baseline.

When at a decision block 150, the new highest acceleration level is higher than the baseline level, the next step at the decision block 120 is initiated. At a decision block 120, the algorithm determines whether to use the low resolution mass displacement value or the high-resolution displacement value. In the current algorithm, the low-resolution mass displacement value is used to implement a minimum of two mass displacement cycles, defined as performing the steps listed from block 111 to the decision block 150. After two mass displacement cycles, in the decision block 120, the baseline acceleration level from using the prior mass displacement value is compared to the new baseline acceleration level using the current mass displacement value. While the new baseline acceleration is lower than the prior baseline acceleration level, the low-resolution mass displacement value is used and the system continues implementing additional mass displacement cycles. When no change in two consecutive baseline accelerations occurs, the algorithm changes to using the high resolution mass displacement value.

Figure 4:
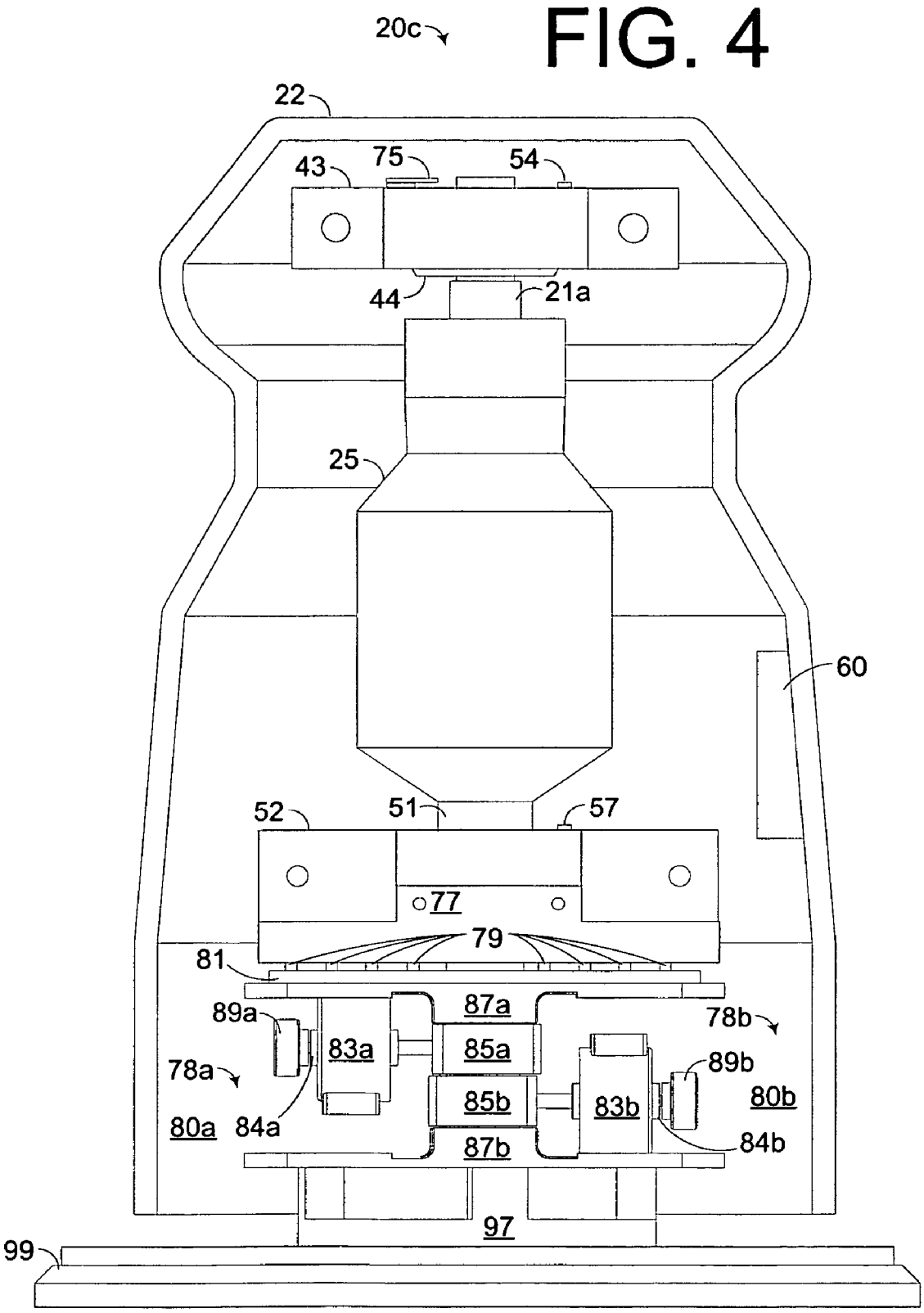
FIG. 4 is a cross-sectional view of an orbital sander having the active dynamic rotation balancing system.

Referring to FIG. 4, a cross-section view of a presently preferred embodiment of the inventive orbital sander 20*c* reveals a compact and functional sanding machine. A sander housing 22 is configured to enclose the workings of the sander and also to serve as an advantageous shaped handgrip. The sander housing 22 encloses a drive train with elements found in non-inventive orbital sander systems: a motor 25 (either electric or pneumatic), a motor shaft 21*a*, a top bearing 44 and top bearing mount 43, a bottom bearing 51 and a bottom bearing mount 52, an orbital bearing assembly 97, and a sanding pad 99. Collectively these elements form a drive train similar to that found in a conventional sander.

Inventive elements of a dynamic balancing system include a controller 60, slip ring brushes 79 along with a slip brush plate 77 to convey signals to a top stepper motor 83*a* and a bottom stepper motor 83*b* mounted respectively on an top motor plate 87*a* and a bottom motor plate 87*b*. In the top correcting assembly 78*a*, a top stepper motor 83*a* drives a top biased correction-mass assembly 85*a* and in a bottom correcting assembly 78*b*, the bottom stepper motor 83*b* drives a bottom biased correction-mass assembly 86*b*. A top thrust transfer pad 84*a* supports a top thrust bearing 89*a* as the top stepper motor 83*a* drives the top biased correction-mass assembly 85*a*. Similarly, the bottom thrust transfer pad 84*b* supports the bottom thrust bearing 89*b* as the bottom stepper motor drives the bottom correction-mass assembly 85*b*. These elements affect the placement of corrective masses in the respective correction-mass assemblies 85*a* and 85*b* at the direction of controller 60. The controller 60 receives input from the advantageously placed top bearing accelerometer 54, the bottom bearing accelerometer 57 and the optical sensor 75.

Figure 5:
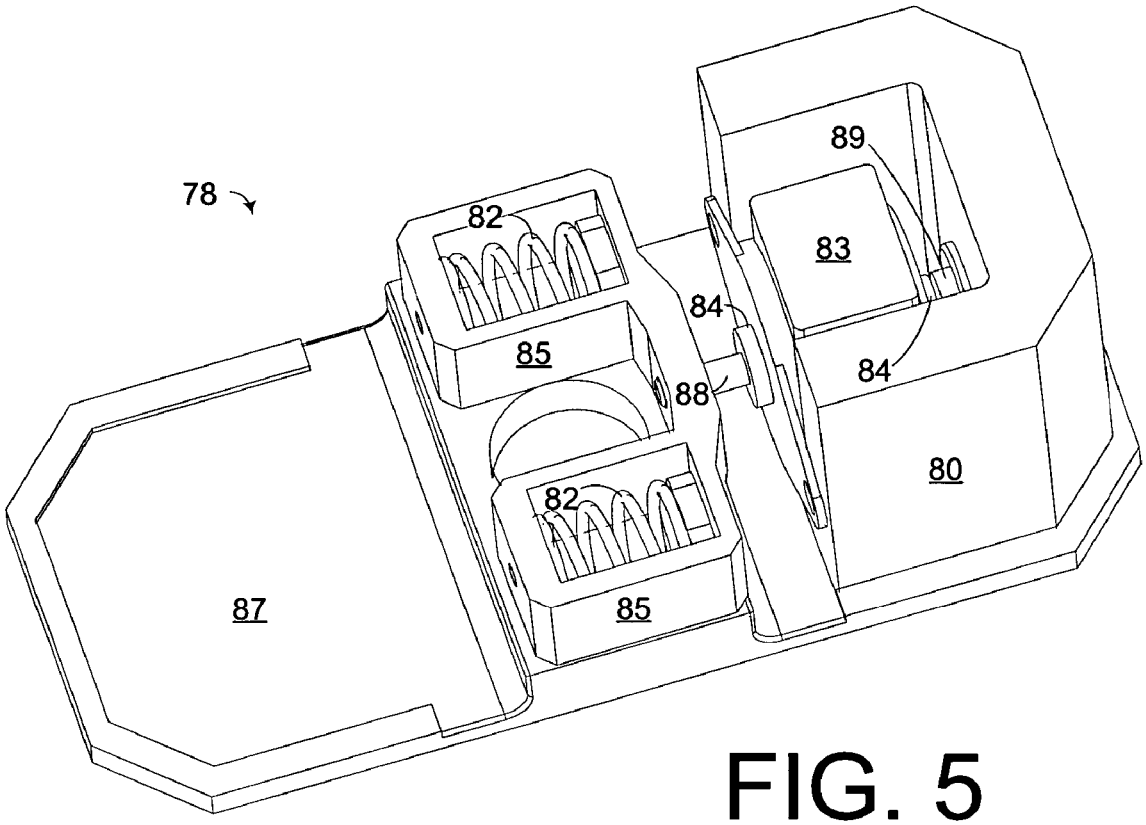
FIG. 5 is a perspective view of a balancing mass assembly for the active dynamic rotation balancing system.

Referring to FIG. 5, an exemplary correcting assembly 78 represents both the top correcting assembly 78*a* (FIG. 4) and bottom correcting assembly 78*b* (FIG. 4). Each correcting assembly 78 is configured to nest with a second correcting assembly 78 that is rotated 180 degrees around a minor (vertical) axis and flipped across a horizontal plane. In this manner, opposed masses are oriented for parallel radial movement with respect to the shaft 21*a* (FIG. 4) while each are axially offset from the motor 25 (FIG. 4) distinct distances. So configured, the masses of the rotating stepper motors 83 are at equal radial distances in a horizontal plane, thereby neutralizing their masses in the horizontal plane in the rotating system, but they are vertically offset to create the vertical distance between correction-mass 36 and correction-mass 30. Similarly, placement of the motor plate 87, the thrust transfer pad 84, and the thrust bearing 89, are placed to compensate for each other in the horizontal plane in the rotating system. Although the motor plate 87, the thrust transfer pad 84, and the thrust bearing 89 are vertically offset from each corresponding other, the active dynamic rotational balancing system correctly compensates for this offset. Stepper motor mount 80, is held in place by motor plate 87 and contains the stepper motor 83, thrust transfer pad 84, and the thrust bearing 89.

Built on the motor plate 87 to give rigidity and exact placement of remaining elements, the correction-mass assembly 78 includes the stepper motor mount 80, thrust transfer pad 80, the thrust bearing 89, the stepper motor 83, a configured correction-mass 85 and a matched pair of biasing springs 82. A stepper motor armature 88 rotates 1/20th of a revolution for each step with a pitch advantageously selected to allow fine resolution movement of the correction-mass 85, a 0.25 mm screw pitch is selected in the presently preferred embodiment so the correction-mass 85 is moved 0.0125 mm for each step.

In operation, during high-speed rotation of the correction-mass assembly 78, a rotational acceleration acts on the armature 88 of the stepper motor 83. The rotational acceleration applies a force to the armature 88 causing misalignment. The thrust transfer pad 84 supporting a thrust bearing 89 is advantageously included to support the armature 88 from misalignment, assuring optimal operation of the stepper motor 83.

The inventive configuration of the correction-mass assembly 78 amplifies the force used to move the correction-masses often against rotational acceleration. In the presently preferred embodiment, the stepper motor 83 can only provide 3 lbs of thrust (radial force) to accomplish the movement of correction-masses. To achieve more than 11 lbs of balancing force, two springs 82 supply a biasing force to counteract the rotational acceleration on the correction-masses 85. In the presently preferred embodiment, when correction-masses 85 at an extreme range of the designed travel, a rotational force of 11 lbs is exerted on the correction-mass. Advantageously in this position the springs 82 supply a total of 9 lbs biasing in opposition to the rotational force. Thus, at even the extreme end of the range there are only 2 lbs. of thrust that the stepper motor 83 must supply to move the correction-masses 85 inward.

Figure 6:
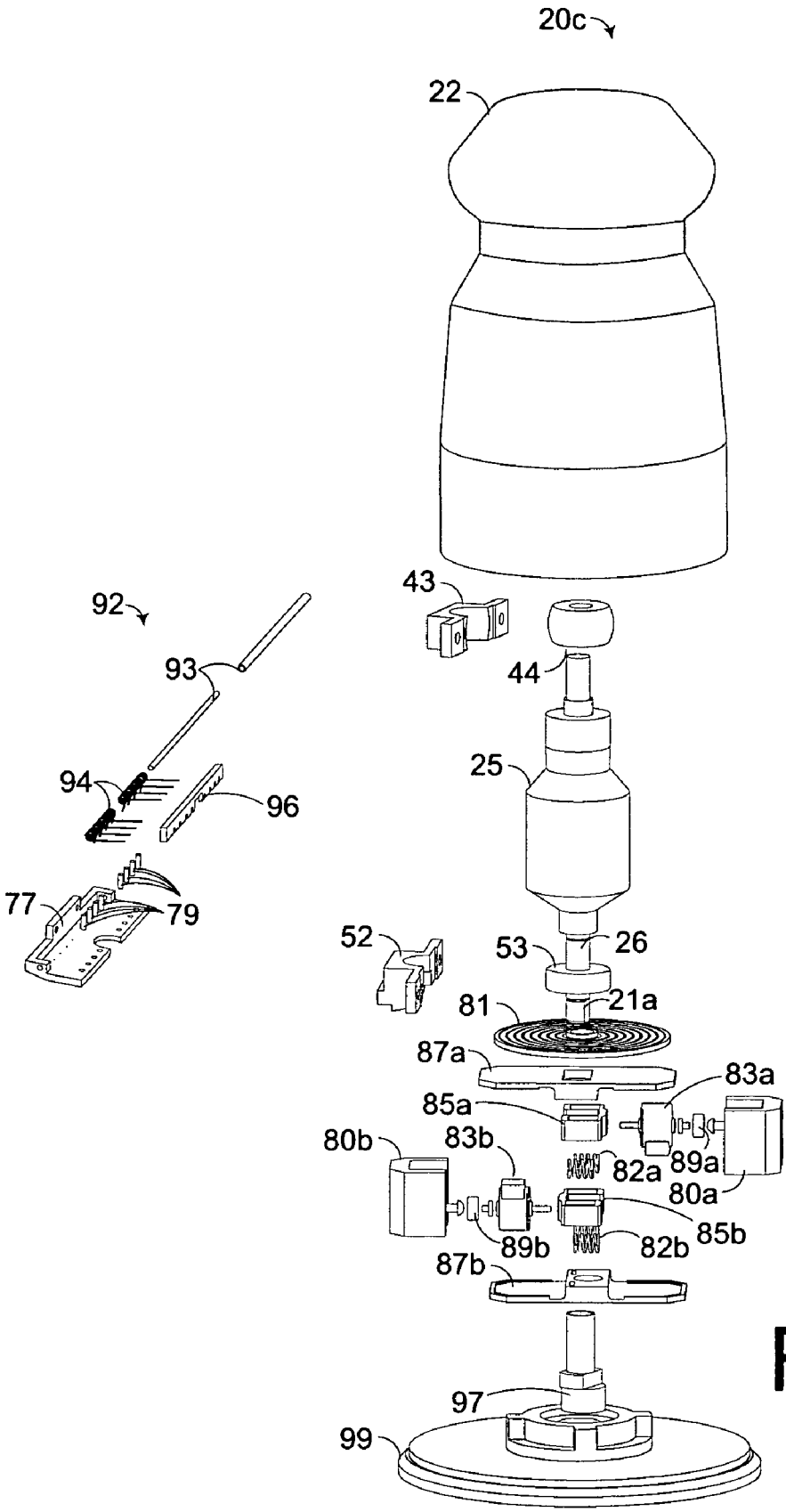
FIG. 6 is an exploded diagram of the orbital sander having the active dynamic rotation balancing system.

Referring to FIG. 6, an exploded view of the inventive sander 20*c* sets forth the several components of the presently preferred embodiment. Though illustrated with an electric motor 25, the presently preferred embodiment may be driven by any suitable motive means including a pneumatic motor as will readily be appreciated by one skilled in the arts.

The housing 22 is, advantageously, formed to enclose the driving means and to conform to an operator's hand. Two bearings, a top bearing 44 in the top bearing mount 43 and a bottom bearing 53 in its bottom bearing mount 52 hold the motor shaft 21*a* in fixed relationship to the housing 22. Additionally, the top bearing mount 43 provides a suitable mount for the top bearing accelerometer 54 (FIG. 4) and the optical sensor 75 (FIG. 4), both advantageously placed to note movement of the motor shaft 21*a*. Similarly, the bottom bearing mount 52 provides a suitable mount for the bottom bearing accelerometer 57. As discussed above the accelerometers 54, and 57 along with the optical sensor 75 or other suitable indexing device such as a Hall effect sensor, allow for measurement and determination of the phase-corrected accelerations on the motor shaft 21*a*. With the determinations of the phase-corrected accelerations on the shaft, the controller 63 can suitably move the correction-masses 85*a*, 85*b* into optimal position to minimize the phase-corrected accelerations.

The motor shaft 21*a* drives the sanding pad 99 and the orbital bearing assembly 97. The orbital bearing assembly 97 contains an offset axis and produces an orbital motion in any designated one of known modes such as random orbital, dual-action, or jitterbug. The motor shaft 21*a* drives the sanding pad 99 in an eccentric orbit around the motor shaft axis 21 (FIGS. 1*a*, 1*b*). For a random orbital sander, the circular sanding pad 99 is mounted to a bearing on its axis; during operation sanding pad 99 is allowed to slip on a sanding pad axis. In a dual-action, the operator can select one of two modes of operation, one being the random orbital operation, the other being a locked pad mode. In the locked pad mode, the pad does not slip on its axis.

In most orbital sanders, the sanding pad 99 is suitably configured to accept round pads with either pressure sensitive adhesive or a hook and pile system. In a jitterbug orbital sander, the sanding pad is square or rectangular and contains two clips to attach the sanding medium. The advantage of a square pad is that the square pad will accept standard sheet sanding medium, and the sheet sanding medium can be cut to the correct size.

The controller 63 (FIG. 2) controls the stepper motors 83 by means, in the presently preferred embodiment, of four voltage sources for each of two stepper motors thus by means of eight voltage signals. Therefore, an eight channel slip-ring system 92 includes a eight channel slip-ring 81 with contact rings in each of the defined channels. Eight contact brushes 79 each contact one of the individual contact rings. Suitable wiring (not shown) allows the voltage signals sent by the controller 63, at the contact rings to reach the two stepper motors 83*a*, 83*b*.

To place the signal on the contact rings, brush springs 94 suitably bias the contact brushes 79 against the contact rings while conducting signals to the brushes by biased contact. A non-conductive slip brush plate 77 holds the slip brushes 79 in orthogonal relation to the contact rings while allowing axial movement of the slip brushes 79. A keeper 96 and an insulated pin 93 fix the biasing slip brush springs 94 in relationship to the slip brushes 79 to suitably apply the biasing force. Both the keeper 96 and the pins are of a nonconductive material to prevent cross-talk between distinct voltage channels.

While the preferred embodiment of the invention has been illustrated and described, as noted above, many changes can be made without departing from the spirit and scope of the invention. For example, an additional adjusting mechanism that allows the operator to increase the orbital eccentricity might be inserted to allow for more aggressive sanding. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A system for active dynamic balancing of a rotating tool driven by a motor having a shaft, the shaft being supported by a first and second bearing on opposing sides of the motor, the system comprising:

an acceleration sensing assembly configured to sense radial accelerations on the shaft producing an acceleration signal indicative of the radial accelerations;

a correcting mass assembly, the correcting mass assembly configured to rotate with the shaft and to move at least one mass radially to the shaft responsive to a correcting signal; and a controller configured to receive the acceleration signal generating a correcting signal by means of a closed loop algorithm based upon the acceleration signal.

2. The system of claim 1, wherein the acceleration sensing assembly comprises:

a first accelerometer configured to measure radial accelerations of the first bearing to produce a first acceleration signal; and the acceleration signal comprises the first acceleration signal.

3. The system of claim 2, wherein the acceleration sensing assembly further comprises:

a shaft indexing sensor to produce an indexing signal; and the acceleration signal further comprises the indexing signal.

4. The system of claim 2, wherein the acceleration sensing assembly further comprises:

a second accelerometer configured to measure radial accelerations of the second bearing to produce a second acceleration signal; and the acceleration signal further comprises the second acceleration signal.

5. The system of claim 1, wherein:

the correcting signal comprises a first correcting signal; and the correcting mass assembly comprises a first correcting mass configured to rotate with the shaft and to move radially along a first line perpendicular to an axis of the shaft responsive to the first correcting signal.

6. The system of claim 5, wherein:

the correcting signal further comprises a second correcting signal; and the correcting mass assembly further comprises a second correcting mass configured to rotate with the shaft and to move radially a second line perpendicular to the shaft, parallel and spaced apart from the first line responsive to the second correcting signal.

7. A method for active dynamic balancing of a rotating tool driven by a motor having a shaft, the shaft being supported by a first and second bearing on opposing sides of the motor, the system comprising:

sensing radial accelerations on the shaft;

generating an acceleration signal indicative of the radial accelerations; and adjusting a correcting mass in a correcting mass assembly responsive to the acceleration signal, the correcting mass assembly configured to rotate with the shaft and to move at least one correcting mass radially to the shaft.

8. The method of claim 7, wherein sensing radial acceleration comprises:

sensing acceleration at a first accelerometer configured to measure radial accelerations of the first bearing to produce a first acceleration signal; and wherein the acceleration signal comprises the first acceleration signal.

9. The method of claim 8, wherein sensing radial acceleration further comprises:

sensing acceleration at a second accelerometer configured to measure radial accelerations of the second bearing to produce a second acceleration signal; and wherein the acceleration signal further comprises the second acceleration signal.

10. The method of claim 8, wherein sensing radial acceleration further comprises:

a shaft indexing sensor to produce an indexing signal; and the acceleration signal further comprises the indexing signal.

11. The method of claim 7, wherein:

generating an acceleration signal comprises generating a first correcting signal; and adjusting the correcting mass further comprises adjusting a first correcting mass configured to rotate with the shaft and to move radially along a first line perpendicular to an axis of the shaft responsive to the first correcting signal.

12. The method of claim 7, wherein:

generating an acceleration signal comprises generating a second correcting signal; and adjusting the correcting mass further comprises adjusting a second correcting mass configured to rotate with the shaft and to move radially a second line perpendicular to the shaft, parallel and spaced apart from the first line responsive to the second correcting signal.

13. The method of claim 7, wherein adjusting the correcting mass further comprises adjusting the correcting mass according to a closed loop algorithm based upon the acceleration signal.

* * * * *